United States Patent [19]

Unger et al.

[11] 4,118,938

[45] Oct. 10, 1978

[54] APPARATUS FOR AND METHOD OF DRIVING TUNNELS

[75] Inventors: Eberhard Unger, Lünen; Wolf-Rüdiger Von Schenk, Borstel bei Winsen, Luhe, both of Fed. Rep. of Germany

[73] Assignee: Gewerkschaft Eisenhutte Westfalia, Lunen, Fed. Rep. of Germany

[21] Appl. No.: 738,419

[22] Filed: Nov. 3, 1976

[30] Foreign Application Priority Data

Nov. 7, 1975 [DE] Fed. Rep. of Germany ..... 2550050

[51] Int. Cl.[2] ..... E21D 11/10

[52] U.S. Cl. ..... 405/145; 405/146

[58] Field of Search ..... 61/45 R, 85, 42, 84

[56] References Cited

U.S. PATENT DOCUMENTS

| | | | |
|---|---|---|---|
| 3,561,223 | 2/1971 | Tabor | 61/85 |
| 3,733,835 | 5/1973 | Jacobs | 61/85 X |
| 3,788,087 | 1/1974 | Patin | 61/85 X |
| 3,834,170 | 9/1974 | Lobbe et al. | 61/85 X |

FOREIGN PATENT DOCUMENTS

| | | | |
|---|---|---|---|
| 1,216,915 | 5/1966 | Fed. Rep. of Germany | 61/85 |

*Primary Examiner*—Mervin Stein
*Assistant Examiner*—David H. Corbin
*Attorney, Agent, or Firm*—Sughrue, Rothwell, Mion, Zinn and Macpeak

[57] ABSTRACT

Apparatus for use in tunnel driving employs a drive shield of known type with elongate drive members arranged side-by-side and supported and guided by a rigid frame. Hydraulic rams are used to alternately advance individual members or groups of members and the frame. Fluid concrete is introduced behind the shield to form a permanent lining supported by formwork and sealed to the tunnel wall by sheet material. The fluid concrete is contacted during its setting period by a hollow ring member of the formwork. The ring member is provided with a filter structure permitting water to be withdrawn by suction. Further separate hydraulic rams interconnect the ring member and the frame of the drive shield enabling the fluid concrete to be compressed. Some of the drive members have prolonged thin rear extensions which form tails extending partly around the concreting zone in contact with the tunnel wall. Pipes are provided to introduce further concrete or other filling material into the gaps created when these tails are shifted up.

12 Claims, 2 Drawing Figures

APPARATUS FOR AND METHOD OF DRIVING TUNNELS

BACKGROUND TO THE INVENTION

The present invention relates to apparatus for, and a method of, driving a tunnel, adit, gallery or similar excavation referred to throughout this specification and claims as a tunnel.

It is known to drive a tunnel with the aid of a forward cutting cylinder shield device and to produce a lining for the tunnel by introducing fluid concrete into a space formed behind the shield device. It is important to produce the concrete lining as quickly as possible to avoid settlement of the surrounding material and to preclude breakage or caving in of the tunnel wall. Nevertheless, the setting time of the concrete usually means that the tunnel driving cannot proceed at the optimum speed of advancement of the device effecting the tunnel driving. To reduce the concrete setting time, it is known, for example from U.S. Pat. No. 3,834,170, assigned to the assignee of this application, to withdraw water from the fluid concrete via filter plates thrust against the concrete by fluid rams serving to advance the device. It is also known to enhance this effect by creating a suction on the filters. One major disadvantage of the prior art is that although the driving and concreting operations can be carried out independently the compression of the fluid concrete, usually occurs when the shield device is advancing and needs a stable firm abutment. Where the concrete still contains a lot of water adequate retainment and support of the concrete with strong formwork is necessary.

Where the so-called knife or drive shields are used which employ a series of elongate cutter planks carried by a frame, rams are coupled between the frame and the planks and enable the shield to be advanced as a unit without requiring any additional support by the tunnel lining even indirectly. However, in this case, special additional measures such as temporary linings, are usually adopted to support the critical tunnel wall zone between the rear of the shield and the permanent lining.

A general object of this invention is to provide an improved apparatus for and method of tunnel driving.

SUMMARY OF THE INVENTION

According to one aspect of the invention there is provided apparatus for use in driving tunnels; said apparatus comprising a drive shield composed of a plurality of elongate drive members arranged side-by-side in parallel relationship, a frame supporting the members for individual longitudinal displacement, rams connected between the frame and the drive members for alternately advancing the drive members and the frame, means defining a fluid-concrete reception space for producing a concrete lining supporting the tunnel wall rearwardly of the advancing direction, said defining means at least including a body provided with filter means for contacting the fluid concrete in the reception space to permit withdrawal of water by suction and further rams connecting said body to the frame of the drive shield and permitting the fluid concrete to be compressed.

According to another related aspect of the invention there is provided a method of driving a tunnel by means of apparatus employing a drive shield with a plurality of elongate drive members arranged side-by-side in parallel relationship, a frame supporting the drive members for individual longitudinal displacement and rams connected between the frame and the drive members; said method comprising operating the rams to advance the drive members in succession, operating the rams to shift up the frame when the drive members have all been advanced, introducing fluid concrete into a reception space rearwardly of the drive shield and independently of the advancement thereof, and withdrawing water from the fluid concrete by compressing the concrete by operating further rams disposed between the frame and a body provided with filter means contacting the fluid concrete and by creating a suction on the filter means.

In accordance with the invention the advancing of the drive members and the frame can be effected without imparting pressure to the fluid concrete and the pressure for compressing the concrete can be produced solely by the further rams coupled between the body and the frame. In general, the means defining the concrete reception space may comprise a simple lightweight form, conveniently cylindrical, spaced from the tunnel wall and provided with one or more radial openings for admitting the fluid concrete. The axial limitations on the reception space would then be the body and its filter means at the front end and a previously introduced concrete section disposed rearwardly remotely from the body. To promote efficient suction of the water from the concrete reception space it is desirable to use lining sheets of impervious material, conveniently a flexible reinforced plastics film or foil, which seals the tunnel wall from the concrete reception space.

The body itself may be a simple hollow thrust ring with one wall incorporating a filter or filters. The interior of this ring can then be connected to a source of suction which creates a low pressure in the ring to draw off the water from the fluid concrete.

Preferably the stroke of the further rams is greater or at least equal to the stroke of the main rams of the drive shield and in one constructional form the stroke of the further rams is made at least twice that of the rams of the drive shield. This permits the drive shield to perform several complete shifting cycles while the concrete is allowed to set and the body is kept more or less stationary. The body can however follow up with the frame when desired and here it is desirable to leave the form in position to support the still-hardening concrete section. A new form can then be introduced between the body and the previously-used form to produce a new concrete reception space. In due course when the concrete sets fully the associated form can be removed for re-use.

To provide adequate support for the tunnel wall over the critical zone between the drive shield and the lining section. it is desirable to provide the drive members at the roof and sides of the tunnel with thin rear extensions which form tails partly surrounding the concrete reception space. The aforementioned lining sheet or sheets may lie on the inside of these rear extensions. The length of the extensions is preferably greater or at least equal to the length of the concrete section produced by introducing concrete into the reception space. In order to avoid settlement or breakage of the tunnel wall when the extensions are drawn up as their drive members advance it is desirable to equip these extensions with pipes or the like at their exteriors which enable a self-setting filling material to be injected in the gaps left at the tunnel wall when the members in question are advanced. Where the preferred lining sheets are used, the filling material, which may also be concrete, would be injected between a lining sheet and the tunnel wall. The pipes fed from a source of fluid filling material under pressure can lead back through the body, e.g., thrust ring.

The invention may be understood more readily, and various other features of the invention may become more apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
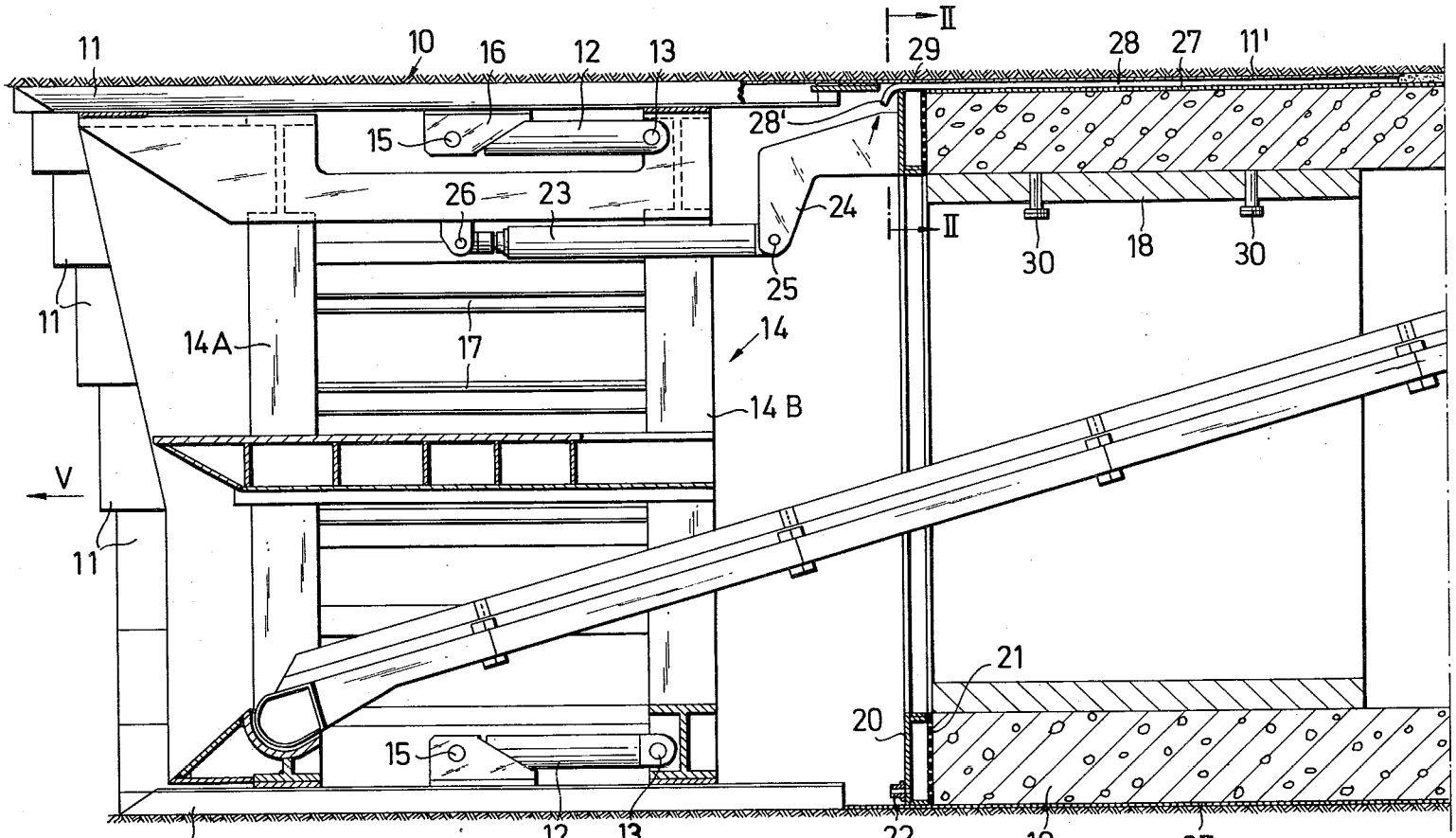
FIG. 1 is a schematic sectional side view of apparatus made in accordance with the invention.
Figure 2:
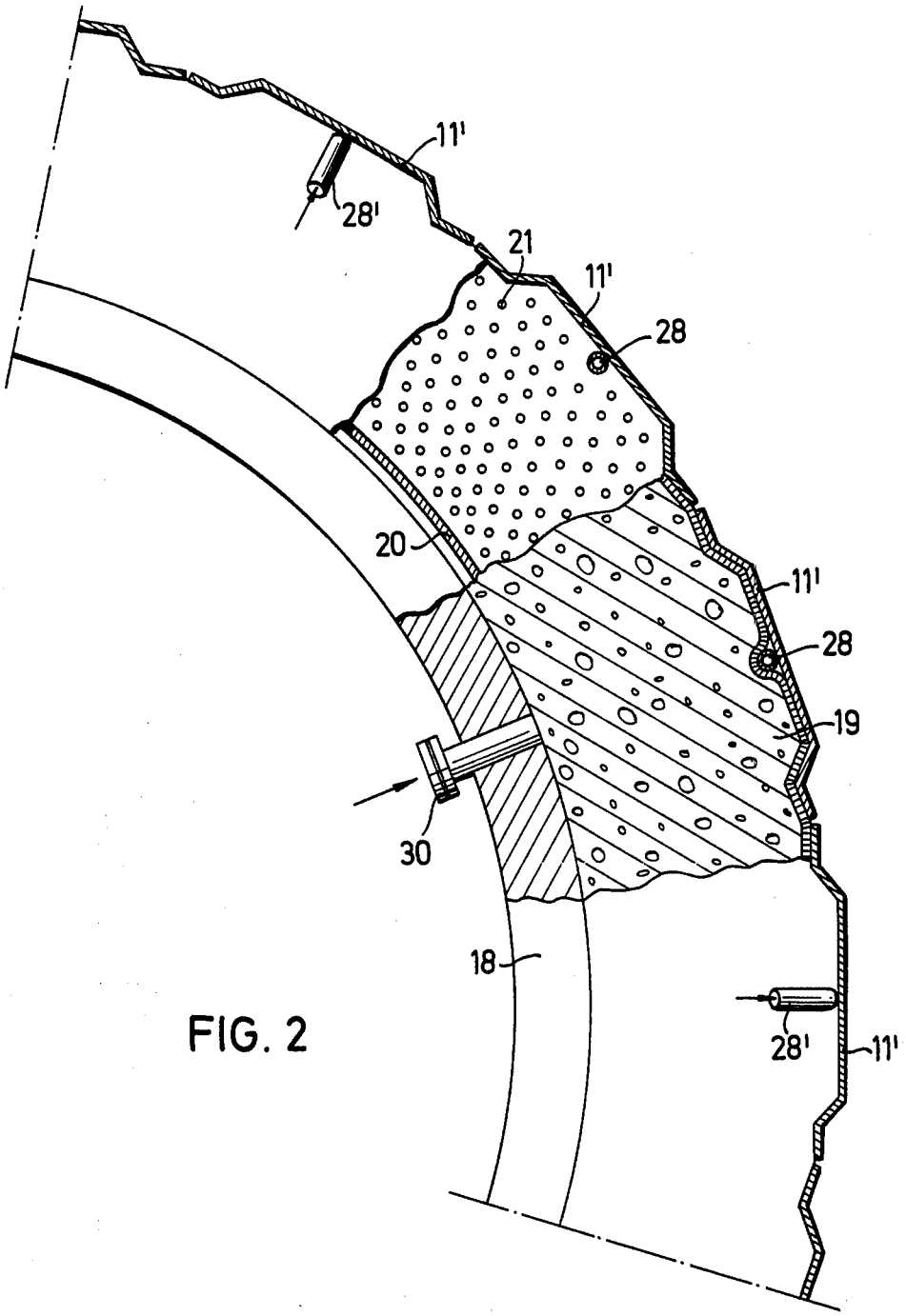
FIG. 2 is an enlarged sectional end view of a rear part of the apparatus, the view being taken along the line II—II of FIG. 1.

As shown in the drawings the apparatus employs a drive shield 10 composed of a number of elongate drive members or cutter planks 11 arranged side-by-side in parallel relationship and supported and guided by a rigid frame 14. The members 11 contact and support the forward region of the wall of a tunnel or similar excavation effected by the apparatus and for convenience the wall is referred to as the tunnel wall. The members 11 are individually displaceable and are shifted forward in the direction of arrow V either individually or in groups with the aid of hydraulic shifting rams 12. At least the members 11 extending over the roof of the tunnel and more preferably over the roof and sides of the tunnel have reduced thickness extensions 11' forming tails projecting well beyond the rear of the frame 14. In the illustrated construction, each of the members 11 is provided with one of the rams 12. Each ram 12 has its cylinder connected via a pivot joint 13 to the frame 14 and its piston rod connected via a pivot joint 15 to a bracket 16 located at the underside of the associated member 11. The frame 14 is composed of two sections 14A, 14B spaced apart longitudinally of the tunnel and interconnected by a bracing structure 17. In known manner the rams 12 are operated to extend and advance the members 11 successively. When each member 11 or group of members 11 is being advanced the remaining stationary members 11 and the frame 14 act as an abutment for the shifting force or forces. When all the members 11 have been advanced in this way the rams 12 are operated in unison in the reverse sense to retract and draw up the frame 14. During this operational stage the members 11 in frictional contact with the tunnel wall act as an abutment for the shifting forces. A cutting or material removing device (not shown) can attack the working face in known manner and the spoil ca be removed with a conveyor as represented in FIG. 1.

In order to support the tunnel wall behind the shield 10 a permanent concrete lining is formed which is advanced as the shield 10 progresses in the forward direction. The concrete lining is produced by successive individually formed concrete lining sections each typically of about 2 meters in axial length, i.e., along the tunnel. These sections which combine to form the continuous lining are created by introducing fluid concrete into a space between the tunnel wall and a removable form 18 conveniently a cylinder. The form 18 which can be of light weight is provided with radial bores and connectors 30 which can be connected to a source of fluid concrete under pressure.

In FIG. 1 the last concrete section laid is denoted 19. The form 18 adjoins or abuts a front form or wall for the concrete reception space. In this case a body in the form of a thrust ring 20 defines the forward de-limiting zone for the space into which the fluid concrete is introduced. The rearward delimiting zone for the concrete section 19 would be the front end of the concrete lining section previously created to the right-hand side of FIG. 1. The ring 20 is hollow and is provided with filter means 21 on the side facing the concrete reception space which provides passage for water withdrawn from the fluid concrete. The interior of the ring 20 communicates with one or more connectors 22 permitting the interior of the ring 20 to be connected to a source of suction such as a pump (not shown). The ring 20 is connected to the frame 14 by way of several double-acting hydraulic rams 23. More particularly, on its forward side the ring 20 has brackets 24 to which the cylinders of the rams 23 are connected with pivot pins 25 while the piston rods of these rams 23 are similarly connected with pivot pins 26 to lugs or brackets on the structure 17 of the frame 14. The stroke of the rams 23 is considerably longer than that of the rams 12 and their respective strokes may be in the ratio of 2:1 or greater.

Preferably some four to six rams 23 are distributed around an upper part of the ring 20. As can be appreciated the rams 23 serve two main functions. On the one hand, the rams 23 permit the ring 20 to follow up with the frame 14 while allowing variation in the distance between the ring 20 and the frame 14. On the other hand, the ram 23 can subject the ring 20 to pressure to compress the concrete and thereby enhance the water-expelling operation independently of the rams 12. Moreover, the rams 23 can assist the rams 12 in shifting up the frame 14 while maintaining the ring 20 virtually stationary so that it is not necessary for the ring 20 to always follow up the frame 14 and for example this could occur after successive shifting stages of the shield 10. In a preferred method of operation the introduction of fluid concrete to form the lining section 19 and the withdrawal of water therefrom through the filter means 21, and enhanced by controlled pressure exerted by the rams 23 takes place independently of the advancement of the members 11 with the rams 12. When the members 11 have been advanced however, and the frame 14 needs to be shifted, the rams 12 are retracted as discussed above but the rams 23 are allowed to extend unaided and the pressure is maintained on the ring 20. When the fluid concrete from which the water has been withdrawn is sufficiently self-supporting the rams 23 are operated to draw up the ring 20. Alternatively and if convenient the ring 20 can be drawn up with the frame 14 when the rams 12 are operated.

In any event the form 18 is preferably left in position to support the concrete which is still setting and a further form 18 is introduced between the stationary form 18 and the ring 20. Thereafter a fresh batch of fluid concrete can be introduced between this further form 18 and the tunnel wall to reproduce the conditions represented in FIG. 1. Each form 18 would normally have an axial length commensurate with the stroke of the rams 23 and two or more forms 18 would be employed in a tunnelling operation.

In order to promote efficient suction during the withdrawal of water through the filter means 21 it is useful to employ an impervious lining sheet 27 which covers the wall of the tunnel prior to the introduction of fluid concrete through the form 18. The sheet 27, conveniently a flexible fabric-reinforced plastics foil, then seals the concrete reception space in relation to the tunnel wall. It can be arranged to weld, e.g., by an ultrasonic tool, successive sheets 27 together to produce a continuous jacket. The extension portions 11' of the lengthened members 11 which would be at least equal to the length of each of the concrete sections 19 would be covered over on the inside by the sheet 27 or sheets 27 and, in the absence of special measures, when the associated member 11 is advanced a narrow gap would be left between the sheet 27 and the actual tunnel wall. Preferably to preclude this a self-hardening material is injected into these gaps and fluid concrete can also be used for this purpose. To facilitate this, injection pipes 28 extend over the inside of the portions 11' of the members 11 and project through passages 29 in the ring 20. The ends 28' of the pipes 28 can be connected to a source of suitable fluid material, e.g., concrete, under pressure so that as each prolonged member 11 is advanced the required material is injected into the gap created by the movement of its rear portion 11, as shown in FIG. 1. This will generally inhibit any undesirable slippage or settlement caused by portions of the wall breaking away. The sheets 27 would also tend to reduce the frictional resistance to sliding encountered by the rear portions 11' of the prolonged members 11.

We claim:

1. Apparatus for use in driving tunnels; said apparatus comprising a drive shield composed of a plurality of elongate drive members arranged side-by-side in parallel relationship, a frame supporting the members for individual longitudinal displacement, rams connected between the frame and the drive members for alternately advancing the drive members and the frame, means defining a fluid-concrete reception space for producing a concrete lining supporting the tunnel wall rearwardly of the advancing direction, said defining means at least including a body provided with filter means for contacting the fluid concrete in the reception space to permit withdrawal of water by suction, further rams connecting said body to the frame of the drive shield and permitting the fluid concrete to be compressed, at least some of the plurality of drive members having rear extensions which project rearwardly beyond the frame and over the concrete reception space, each of said rear extensions provided with pipe means which extend to the rear of its extension such that when the associated drive member is advanced a space is formed by the advance of said extension, and filling material can be injected through said pipe means, wherein the space formed by the advance of said extension is gradually filled with filling material starting at the rear of said space and working toward the front of said space.

2. Apparatus according to claim 1, wherein the stroke of the further rams is greater than the stroke of the first-mentioned rams.

3. Apparatus according to claim 1, wherein the body takes the form of a hollow thrust ring the interior of which can be subjected to reduced pressure to draw off water from the fluid concrete through the filter means.

4. Apparatus according to claim 1, wherein the drive members with extensions are arranged over the roof and sides of the tunnel.

5. Apparatus according to claim 1, wherein the pipe means of the extensions project through the body.

6. Apparatus according to claim 1, wherein said defining means further comprises a separate form spaced from the tunnel wall and provided with at least one opening for admitting fluid concrete into the concrete reception space.

7. Apparatus according to claim 1, wherein at least one impervious sheet is provided adjacent the tunnel wall, said sheet being disposed at the insides of the extensions so as to contact the fluid concrete introduced into the concrete reception space.

8. Apparatus according to claim 1, wherein each of the extensions is reduced in relation to the remainder of the associated drive member.

9. Apparatus according to claim 1, wherein the length of each extension is at least as great as the length of a resultant concrete section formed by introducing fluid concrete into said reception space.

10. A method of driving a tunnel by means of apparatus employing a drive shield with a plurality of elongate drive members arranged side-by-side in parallel relationship, at least some of the drive members having rear extension, a frame supporting the drive members for individual longitudinal displacement, and rams connected between the frame and the drive members; said method comprising the steps of operating the rams to advance the drive members in succession, operating the rams to shift up the frame when the drive members have all been advanced, introducing fluid concrete into a reception space rearwardly of the drive shield but within the rear extensions, and independently of the advancement thereof, withdrawing water from the fluid concrete by compressing the concrete by operating further rams disposed between the frame and a body provided with filter means contacting the fluid concrete and by creating a suction on the filter means, injecting a filling material into the respective space formed by each extension when its associated drive member is advanced, the filling material being injected into each space by a respective pipe fastened to the corresponding extension, each of said pipes extending toward the rear of its extension such that the space is gradually filled with filling material starting from the rear of said space and working towards the front thereof, whereby the formation of air pockets in the material filling said space is prevented.

11. A method according to claim 10, and further comprising utilizing at least one impervious sheet arranged at the inside of the extensions and adjacent the tunnel wall to seal the concrete reception space from the tunnel wall, the filling material being injected between the tunnel wall and said sheet.

12. A method according to claim 10, and further comprising advancing the body with the frame, supporting the concrete section produced by introducing fluid concrete into the reception space with a removable form which remains in position, and introducing a further form between the first form and the body to define a new concrete reception space, and the concrete being admitted to said space through at least one opening in the form.

* * * * *